US005383437A

United States Patent [19]

Cook et al.

[11] Patent Number: 5,383,437

[45] Date of Patent: Jan. 24, 1995

[54] INTEGRITY CONFIRMATION OF EVAPORATIVE EMISSION CONTROL SYSTEM AGAINST LEAKAGE

[75] Inventors: John E. Cook; Murray F. Busato, both of Chatham, Canada; Gary L. Casey, Troy; John D. Hanson, Bloomfield Hills, both of Mich.

[73] Assignee: Siemens Automotive Limited, Chatham, Canada

[21] Appl. No.: 995,484

[22] Filed: Dec. 23, 1992

[51] Int. Cl.[6] ..... F02M 37/04

[52] U.S. Cl. ..... 123/520; 123/198 D

[58] Field of Search ..... 123/518, 520, 519, 516, 123/198 D, 521; 417/46, 34, 35, 28, 395

[56] References Cited

U.S. PATENT DOCUMENTS

| | | | |
|---|---|---|---|
| 3,176,459 | 4/1965 | Parker | 417/34 |
| 4,139,332 | 2/1979 | Cantrell | 417/46 |
| 4,140,436 | 2/1979 | Schumacher | 417/28 |
| 4,551,076 | 11/1985 | Dubois | 417/395 |
| 4,621,990 | 11/1986 | Forsythe | 417/395 |
| 4,705,462 | 11/1987 | Balembois | 417/395 |
| 4,759,184 | 7/1988 | Kita | 417/34 |
| 4,846,119 | 7/1989 | Gever | 417/395 |
| 4,856,969 | 8/1989 | Forsythe | 417/395 |
| 5,146,902 | 9/1992 | Cook | 123/518 |
| 5,193,512 | 3/1993 | Steinbrenner | 123/198 D |
| 5,216,995 | 6/1993 | Hosoda | 123/520 |
| 5,246,351 | 9/1993 | Horn | 417/395 |

*Primary Examiner*—Carl S. Miller

*Attorney, Agent, or Firm*—George L. Boller; Russel C. Wells

[57] ABSTRACT

An on-board diagnostic system for an evaporative emission control system of an internal combustion engine powered vehicle employs a positive displacement reciprocating pump to create in evaporative emission space a pressure that differs significantly from ambient atmospheric pressure. The pump is powered by using engine intake manifold vacuum to force an intake stroke during which both an internal spring is increasingly compressed and a charge of ambient atmospheric air is created in an air pumping chamber space. Vacuum is then removed, and the spring relaxes to force a compression stroke wherein a portion of the air charge is forced into the evaporative emission space. The rate at which the pump reciprocates to alternately execute intake and compression strokes indicates the pressure and flow through a leak in the evaporative emission space. Detection of this rate serves as a measurement of leakage for the purpose of distinguishing integrity of the evaporative emission space from non-integrity.

33 Claims, 5 Drawing Sheets

INTEGRITY CONFIRMATION OF EVAPORATIVE EMISSION CONTROL SYSTEM AGAINST LEAKAGE

FIELD OF THE INVENTION

This invention relates to evaporative emission control systems for the fuel systems of internal combustion engine powered automotive vehicles, particularly to apparatus and method for confirming the integrity of an evaporative emission control system against leakage.

BACKGROUND AND SUMMARY OF THE INVENTION

A typical evaporative emission control system in a modern automotive vehicle comprises a vapor collection canister that collects volatile fuel vapors generated in the headspace of the fuel tank by the volatilization of liquid fuel in the tank. During conditions conducive to purging, the evaporative emission space which is cooperatively defined by the tank headspace and the canister is purged to the engine intake manifold by means of a canister purge system that comprises a canister purge solenoid valve connected between the canister and the engine intake manifold and operated by an engine management computer. The canister purge solenoid valve is opened by a signal from the engine management computer in an amount that allows the intake manifold vacuum to draw volatile vapors from the canister for entrainment with the combustible mixture passing into the engine's combustion chamber space at a rate consistent with engine operation to provide both acceptable vehicle driveability and an acceptable level of exhaust emissions.

U.S. governmental regulations require that certain future automotive vehicles powered by internal combustion engines which operate on volatile fuels such as gasoline have their evaporative emission control systems equipped with on-board diagnostic capability for determining if a leak is present in the evaporative emission space. It has heretofore been proposed to make such a determination by temporarily creating a pressure condition in the evaporative emission space which is substantially different from the ambient atmospheric pressure, and then watching for a change in that substantially different pressure which is indicative of a leak.

Commonly assigned U.S. Pat. No. 5,146,902 "Positive Pressure Canister Purge System Integrity Confirmation" discloses a system and method for making such a determination by pressurizing the evaporative emission space by creating a certain positive pressure therein (relative to ambient atmospheric pressure) and then watching for a drop in that pressure indicative of a leak. Leak integrity confirmation by positive pressurization of the evaporative emission space offers certain benefits over leak integrity confirmation by negative pressurization, as mentioned in the referenced patent.

In some respects, the present invention relates to an improvement on the positive pressurization system and method of U.S. Pat. No. 5,146,902, although in others, it embodies more generic principles.

One aspect of the invention relates to a new and unique arrangement and technique for measuring the effective orifice size of relatively small leakage from the evaporative emission space once the pressure has been brought substantially to a predetermined magnitude that is substantially different from ambient atmospheric pressure. Generally speaking, this involves the use of a reciprocating pump to create such pressure magnitude in the evaporative emission space and a switch that is responsive to reciprocation of the pump mechanism. More specifically, the pump comprises a movable wall that is reciprocated over a cycle which comprises an intake stroke and a compression stroke to create such pressure magnitude in the evaporative emission space. On an intake stroke, a charge of atmospheric air is drawn in an air pumping chamber space of the pump. On an ensuing compression stroke, the movable wall is urged by a mechanical spring to compress a charge of air so that a portion of the compressed air charge is forced into the evaporative emission space. On a following intake stroke, another charge of atmospheric air is created.

At the beginning of the integrity confirmation procedure, the pump reciprocates rapidly, seeking to build pressure toward a predetermined level. If a gross leak is present, the pump will be incapable of pressurizing the evaporative emission space to the predetermined level, and hence will keep reciprocating rapidly. Accordingly, continuing rapid reciprocation of the pump beyond a time by which the predetermined pressure should have been substantially reached will indicate the presence of a gross leak, and the evaporative emission control system may therefore be deemed to lack integrity.

The pressure which the pump strives to achieve is set essentially by its aforementioned mechanical spring. In the absence of a gross leak, the pressure will build toward the predetermined level, and the rate of reciprocation will correspondingly diminish. For a theoretical condition of zero leakage, the reciprocation will cease at a point where the spring is incapable of forcing any more air into the evaporative emission space.

Leaks smaller than a gross leak are detected in a manner that is capable of giving a measurement of the effective orifice size of leakage, and consequently the invention is capable of distinguishing between very small leakage which may be deemed acceptable and somewhat larger leakage which, although considered less than a gross leak, may nevertheless be deemed unacceptable. The ability to provide some measurement of the effective orifice size of leakage that is smaller than a gross leak, rather than just distinguishing between integrity and non-integrity, may be considered important for certain automotive vehicles, and in this regard the invention is especially advantageous since the means by which the measurement is obtained is accomplished by an integral component of the pump, rather than by a separate pressure sensor.

The means for obtaining the measurement comprises a switch which, as an integral component of the pump, is disposed to sense reciprocation of the pump mechanism. Such a switch may be a reed switch, an optical switch, or a Hall sensor, for example. The switch is used both to cause the pump mechanism to reciprocate at the end of a compression stroke and as an indication of how fast air is being pumped into the evaporative emission space. Since the rate of pump reciprocation will begin to decrease as the pressure begins to build, detection of the rate of switch operation can be used in the first instance to determine whether or not a gross leak is present. As explained above, a gross leak is indicated by failure of the rate of switch operation to fall below a certain frequency within a certain amount of time. In the absence of a gross leak, the frequency of switch operation provides a measurement of leakage that can be used to distinguish between integrity and non-integrity of the evaporative emission space even though the leakage has already been determined to be less than a gross leak. Once the evaporative emission space pressure has built substantially to the predetermined pressure, the switch's indication of a pump reciprocation rate at less than a certain frequency will indicate integrity of the evaporative emission space while indication of a greater frequency will indicate non-integrity.

Further aspects of the invention relate to the organization and arrangement of the pump, both per se and in cooperative association with other components. Generally speaking, they include: certain constructional details of the pump; the integration of a vent valve for the evaporative emission space with the pump; a selectively operably solenoid valve for powering the pump from engine intake manifold vacuum; and the integration of this solenoid valve with the pump. Two different forms of both the integrated vent valve and the selectively operable solenoid valve are disclosed.

The invention enables integrity confirmation to be made while the engine is running. It also enables integrity confirmation to be made over a wide range of fuel tank fills between full and empty so that the procedure is for the most part independent of tank size and fill level. Likewise, the procedure is largely independent of the particular type of volatile fuel being used. The invention provides a reliable, cost-effective means for compliance with on-board diagnostic requirements for assuring leakage integrity of an evaporative emission control system.

The foregoing, along with additional features, advantages, and benefits of the invention, will be seen in the ensuing description and claims which should be considered in conjunction with the accompanying drawings. The drawings disclose a presently preferred embodiment of the invention according to the best mode contemplated at this time for carrying out the invention.

DESCRIPTION OF THE PREFERRED EMBODIMENT

Figure 1:
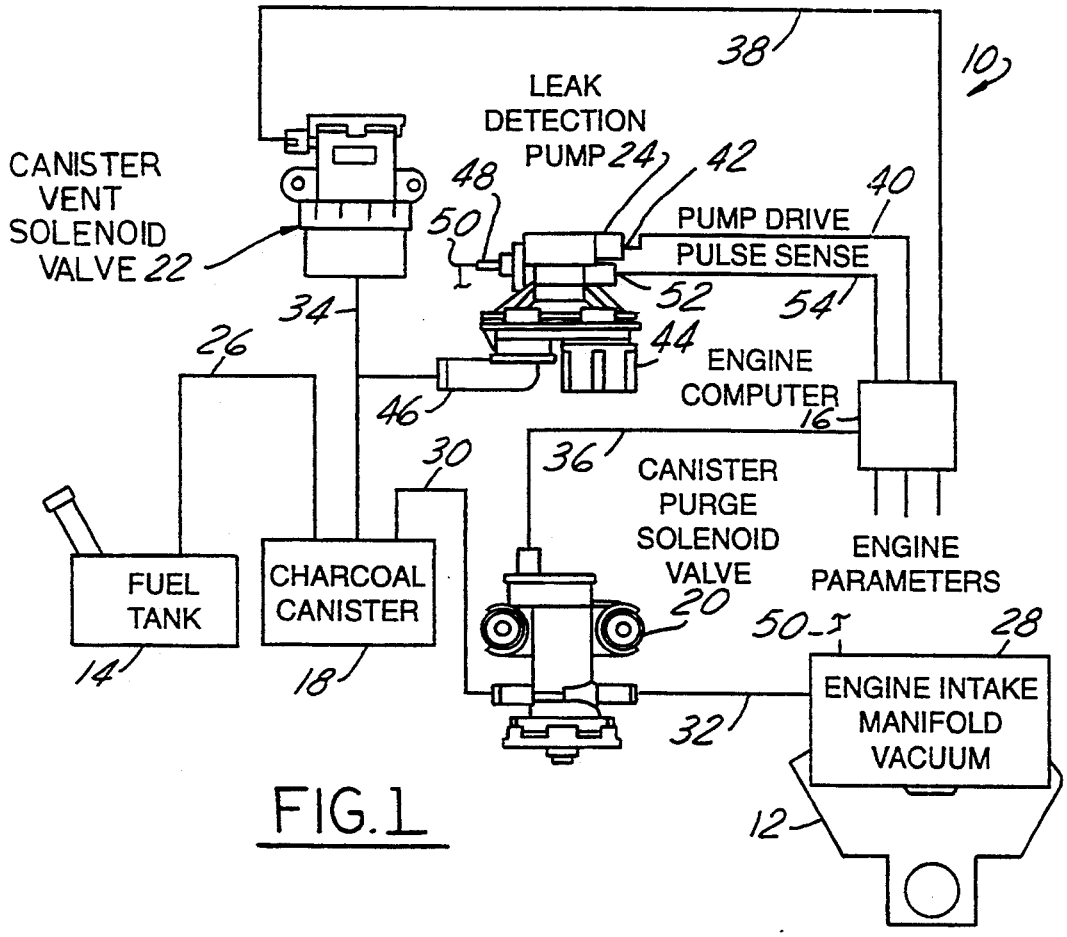
FIG. 1 is a general schematic diagram of an evaporative emission control system embodying principles of the present invention, including relevant portions of an automobile.

FIG. 1 shows an evaporative emission control (EEC) system 10 for an internal combustion engine powered automotive vehicle comprising in association with the vehicle's engine 12, fuel tank 14, and engine management computer 16, a conventional vapor collection canister (charcoal canister) 18, a canister purge solenoid (CPS) valve 20, a canister vent solenoid (CVS) valve 22, and a leak detection pump 24.

The headspace of fuel tank 14 is placed in fluid communication with an inlet port of canister 18 by means of a conduit 26 so that they cooperatively define an evaporative emission space within which fuel vapors generated from the volatilization of fuel in the tank are temporarily confined and collected until purged to an intake manifold 28 of engine 12. A second conduit 30 fluid-connects an outlet port of canister 18 with an inlet port of CPS valve 20, while a third conduit 32 fluid-connects an outlet port of CPS valve 20 with intake manifold 28. A fourth conduit 34 fluid-connects a vent port of canister 18 with an inlet port of CVS valve 22. CVS valve 22 also has an outlet port that communicates directly with atmosphere.

Engine management computer 16 receives a number of inputs (engine parameters) relevant to control of the engine and its associated systems, including EEC system 10. One output port of the computer controls CPS valve 20 via a circuit 36, another, CVS valve 22 via a circuit 38, and another, leak detection pump 24 via a circuit 40. Circuit 40 connects to an input port 42 of pump 24.

Pump 24 comprises an air inlet port 44 that is open to ambient atmospheric air and an outlet port 46 that is fluid-connected into conduit 34 by means of a tee. The pump also has a vacuum inlet port 48 that is communicated by a conduit 50 with intake manifold 28. Still further, the pump has an output port 52 at which it provides a signal that is delivered via a circuit 54 to computer 16.

While the engine is running, operation of pump 24 is commanded from time to time by computer 16 as part of an occasional diagnostic procedure for confirming the integrity of EEC system 10 against leakage. During occurrences of such diagnostic procedure, computer 16 commands both CPS valve 20 and CVS valve 22 to close. At times of engine running other than during such occurrences of the diagnostic procedure, pump 24 does not operate, computer 16 opens CVS valve 22, and computer 16 selectively operates CPS valve 20 such that CPS valve 20 opens under conditions conducive to purging and closes under conditions not conducive to purging. Thus, during times of operation of the automotive vehicle, the canister purge function is performed in the usual manner for the particular vehicle and engine so long as the diagnostic procedure is not being performed. When the diagnostic procedure is being performed, the evaporative emission space is closed so that it can be pressurized by pump 24.

Figure 2:
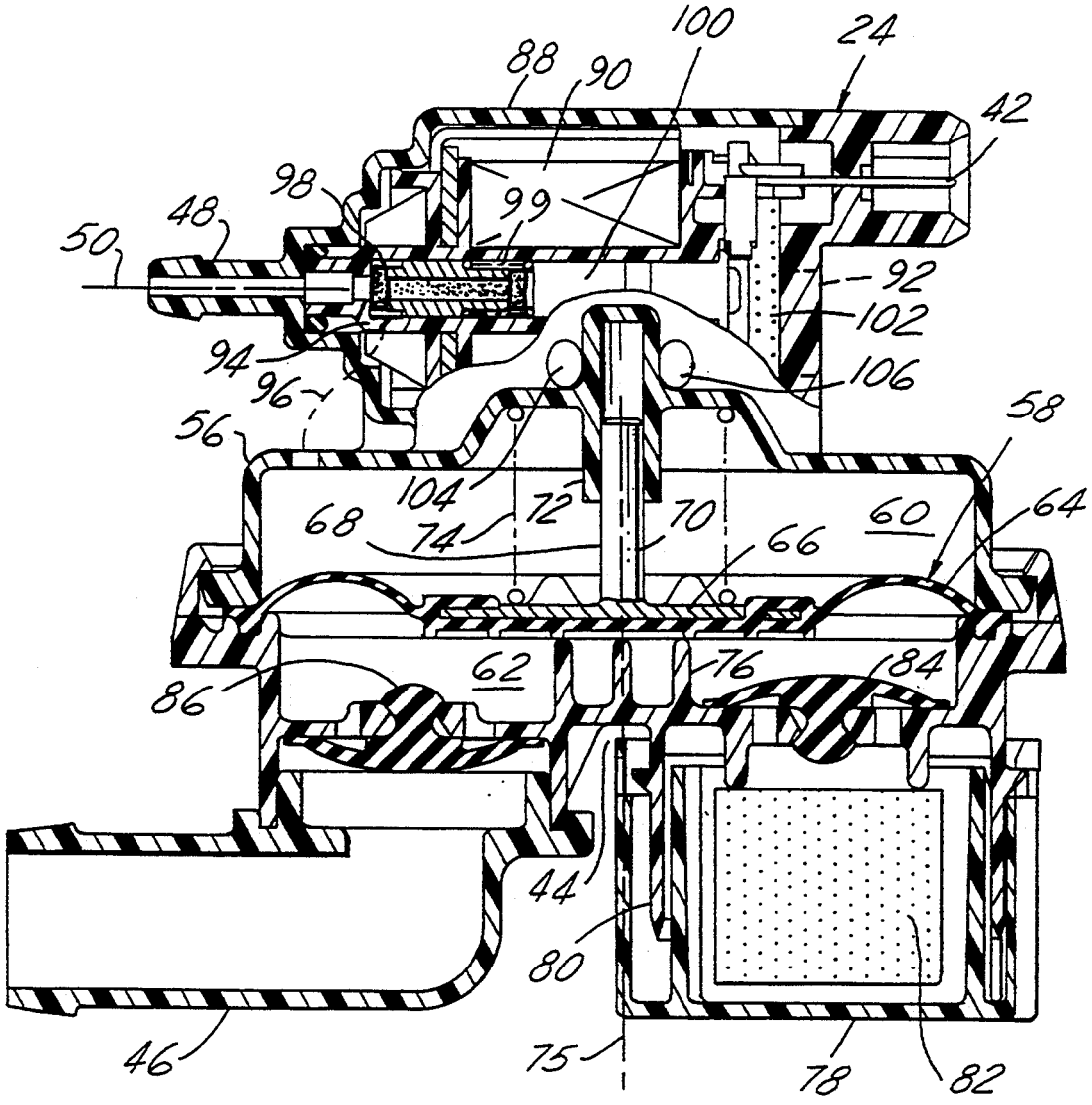
FIG. 2 is a longitudinal cross sectional view through one of the components of FIG. 1, by itself.

Attention is now directed to details of pump 24 with reference to FIG. 2. Pump 24 comprises a housing 56 composed of several plastic parts assembled together. Interior of the housing, a movable wall 58 divides housing 56 into a vacuum chamber space 60 and an air pumping chamber space 62. Movable wall 58 comprises a general circular diaphragm 64 that is flexible, but essentially non-stretchable, and that has an outer peripheral margin captured in a sealed manner between two of the housing parts. The generally circular base 66 of an insert 68 is held in assembly against a central region of a face of diaphragm 64 that is toward chamber space 60. A cylindrical shaft 70 projects centrally from base 66 into a cylindrical sleeve 72 formed in one of the housing parts. A mechanical spring 74 in the form of a helical metal coil is disposed in chamber space 60 in outward circumferentially bounding relation to shaft 70, and its axial ends are seated in respective seats formed in base 66 and that portion of the housing bounding sleeve 72.

Spring 74 acts to urge movable wall 58 axially toward chamber space 62 while the coaction of shaft 70 with sleeve 72 serves to constrain motion of the central region of the movable wall to straight line motion along an imaginary axis 75. The position illustrated by FIG. 2 shows spring 74 forcing a central portion of a face of diaphragm 58 that is toward chamber space 62 against a stop 76, and this represents the position which the mechanism assumes when the pump is not being operated.

Inlet port 44 leads to chamber space 62 while outlet port 46 leads from chamber space 62. Inlet port 44 comprises a cap 78 that is fitted onto a neck 80 of housing 56 such that the two form a somewhat tortuous, but not significantly restricted, path for ambient air to pass through before it can enter chamber space 62. A filter element 82 is also disposed in association with cap 78 and neck 80 such that air can enter chamber space 62 only after it has passed through the filter element. In this way, only filtered air reaches the interior mechanism of the pump.

The wall of housing 56 where inlet air enters chamber space 62 contains a one-way valve 84 that allows air to pass into, but not from, the chamber space via inlet port 44. The illustrated valve is a conventional umbrella-type valve having a stem that is retentively fitted to a hole in the housing wall and a dome whose peripheral margin selectively seals against the wall in outwardly spaced relation to several through-holes in the wall via which air enters chamber space 62. Outlet port 46 comprises a one-way valve 86 which is arranged on the housing wall exactly like valve 84 but in a sense that allows air to pass from, but not enter, chamber space 62 via outlet port 46.

A solenoid valve 88 is disposed atop housing 56, as appears in FIG. 2. Valve 88 comprises a solenoid 90 that is connected with input port 42. In addition to vacuum port 48, valve 88 comprises an atmospheric port 92 for communication with ambient atmosphere and an outlet port 94 that communicates with chamber space 60 by means of an internal passageway 96 that is depicted somewhat schematically in FIG. 2 for illustrative purposes only. Valve 88 further comprises an armature 98 that is biased to the left in FIG. 2 by a spring 99 so that a valve element on the left end of the armature closes vacuum port 48, leaving a valve element on the armature's right end spaced from the left end of a stator 100 that is disposed coaxial with solenoid 90. Atmospheric port 92 has communication with the left end of stator 100 by means of internal passageway structure which includes a filter element 102 between port 92 and the right end of the stator, and a central through-hole extending through the stator from right to left.

In the position depicted by FIG. 2, solenoid 90 is not energized, and so atmospheric port 92 is communicated to chamber space 60, resulting in the latter being at atmospheric pressure. When solenoid 90 is energized, armature 98 moves to the right closing atmospheric port 92 and opening vacuum port 48, thereby communicating vacuum port 48 to chamber space 60.

The pump has two further components, namely a permanent magnet 104 and a reed switch 106. The two are mounted on the exterior of the housing wall on opposite sides of where the closed end of sleeve 72 protrudes. Shaft 70 is a ferromagnetic material, and in the position of FIG. 2, it is disposed below the magnet and reed switch where it does not interfere with the action of the magnet on the reed switch. However, as shaft 70 moves upwardly within sleeve 72, a point will be reached where it shunts sufficient magnetic flux from magnet 104, that reed switch 106 no longer remains under the influence of the magnet, and hence the reed switch switches from one state to another. Let it be assumed that the reed switch switches from open to closed at such switch point, being open for positions below the switch point and closed for positions above the switch point. This switch point is however significantly below the uppermost limit of travel of the shaft, such limit being defined in this particular embodiment by abutment of the upper end of shaft 70 with the closed end wall of sleeve 72. For all upward travel of shaft 70 above the switch point, reed Switch 106 remains closed. When shaft 70 once again travels downwardly; reed switch 106 will revert to open upon the shaft reaching the switch point. Reed switch 106 is connected with output port 52 so that the reed switch's state can be monitored by computer 16.

Sufficient detail of FIG. 2 having thus been described, the operation of the invention may now be explained. First computer 16 commands both CPS valve 20 and CVS valve 22 to be closed. It then energizes solenoid 90 causing intake manifold vacuum to be delivered through valve 88 to vacuum chamber space 60. For the typical magnitudes of intake manifold vacuum that exist when the engine is running, the area of movable wall 58 is sufficiently large in comparison to the force exerted by spring 74 that movable wall 58 is displaced upwardly, thereby reducing the volume of vacuum chamber space 60 in the process while simultaneously increasing the volume of air pumping chamber space 62. The upward displacement of movable wall 58 is limited by any suitable means of abutment and in this particular embodiment it is, as already mentioned, by abutment of the end of shaft 70 with the closed end wall of sleeve 72.

As the volume of air pumping chamber space 62 increases during the upward motion of movable wall 58, a certain pressure differential is created across one-way valve 84 resulting in the valve opening at a certain relatively small pressure differential to allow atmospheric air to pass through inlet port 44 into chamber space 62. When a sufficient amount of ambient atmospheric air has been drawn into chamber space 62 to reduce the pressure differential across valve 84 to a level that is insufficient to maintain the valve open, the valve closes. At this time, air pumping chamber space 62 contains a charge of air that is substantially at ambient atmospheric pressure, i.e. atmospheric pressure less drop across valve 84.

Under typical operating conditions, the time required for the charge of atmospheric air to be created in air pumping chamber space 62 is well defined. This information is contained in computer 16 and is utilized by the computer to terminate the energization of solenoid 90 after a time that is sufficiently long enough, but not appreciably longer, to assure that for all anticipated operating conditions, chamber space 62 will be charged substantially to atmospheric pressure with movable wall 58 in its uppermost position of travel. The termination of the energization of solenoid valve 88 by computer 16 immediately causes vacuum chamber space 60 to be vented to atmosphere. The pressure in chamber space 60 now quickly returns to ambient atmospheric pressure, causing the net force acting on movable wall 58 to be essentially solely that of spring 74.

The spring force now displaces movable wall 58 downwardly compressing the air in chamber space 62. When the charge of air has been compressed sufficiently to create a certain pressure differential across one-way valve 86, the latter opens. Continued displacement of movable wall 58 by spring 74 forces some of the compressed air in chamber space 62 through outlet port 46 and into the evaporative emission space.

When movable wall 58 has been displaced downwardly to a point where shaft 70 ceases to maintain reed switch 106 closed, the latter opens. The switch opening is immediately detected by computer 16 which immediately energizes solenoid 90 once again. The energizing of solenoid 90 now causes manifold vacuum to once again be applied to chamber space 60, reversing the motion of movable wall 58 from down to up. The downward motion of movable wall 58 between the position at which shaft 70 abuts the closed end wall of sleeve 72 and the position at which reed switch 106 switches from closed to open represents a compression stroke wherein a charge of air in chamber space 62 is compressed and a portion of the compressed charge is pumped into the evaporative emission space. Upward motion of movable wall 58 from a position at which reed switch 106 switches from open to closed to a position where the end of shaft 72 abuts the closed end of sleeve 70 represents an intake stroke. It is to be noted that switch 106 will open before movable wall 58 abuts lower limit stop 76, and in this way it is assured that the movable wall will not assume a position that prevents it from being intake-stroked when it is intended that the movable wall should continue to reciprocate after a compression stroke.

At the beginning of a diagnostic procedure, the pressure in the evaporative emission space will be somewhere near atmospheric pressure, and therefore the time required for spring 74 to force a portion of the charge from chamber space 62 into the evaporative emission space will be relatively short. This means that movable wall 58 will execute a relatively rapid compression stroke once vacuum chamber 60 has been vented to atmosphere by valve 88. In such case, it is possible that movable wall 58 may bottom out on stop 76 before vacuum chamber 60 has once again been communicated to intake manifold vacuum by valve 88, but the fact that the movable wall may bottom out is not critical during this portion of the procedure.

If a gross leak is present in the evaporative emission space, pump 24 will be incapable of building pressure substantially to a predetermined level which is utilized in the procedure once the possibility of a gross leak has been eliminated. Hence, continued rapid reciprocation of movable wall 58 over a length of time that has been predetermined to be sufficient to provide for the pressure to build in the evaporative emission space substantially to the level at which a later part of the procedure is otherwise conducted, will indicate the existence of a gross leak, and the procedure may be terminated at this juncture. Thus, the frequency at which switch 106 operates is used in the first instance to determine whether or not a gross leak is present, such gross leak being indicated by continuing rapid actuation of the switch over such a predetermined length of time.

If no gross leak is present, the evaporative emission space pressure will build substantially to a predetermined magnitude, or target level, which is essentially a function of solely spring 74. In the theoretical case of an evaporative emission space which has zero leakage, a point will be reached where spring 74 is incapable of providing sufficient force to force any more compressed air into the evaporative emission space. Accordingly, switch 106 will cease switching when that occurs.

If, once the target pressure has been substantially reached, there is some leakage less than a gross leak, pump 24 will function to maintain pressure in the evaporative emission space by replenishing the losses due to the leakage. A rate at which the pump reciprocates is related to the size of the leak such that the larger the leak, the faster the pump reciprocates and the smaller the leak, the slower it reciprocates. The rate of reciprocation is detected by computer 16 by monitoring the rate at which switch 106 switches. One of the outstanding capabilities of the invention is that the rate of switch actuation can provide a fairly accurate measurement of the effective orifice size of the leakage. Leakage that is greater than a predefined effective orifice size may be deemed unacceptable while a smaller leakage may be deemed acceptable. In this way, the integrity of the evaporative emission space may be either confirmed or denied, even for relatively small effective orifice sizes. At the end of the procedure, computer 16 shuts off pump 24 and allows CPS valve 20 and CVS valve 22 to re-open on subsequent command.

A lack of integrity may be due to any one or more of a number of reasons. For example, there may be leakage from fuel tank 14, canister 18, or any of the conduits 26, 30, and 34. Likewise, failure of either CPS valve 20 or CVS valve 22 to fully close during the procedure will also be a source of leakage and can be detected. Even though the mass of air that is pumped into the evaporative emission space will to some extent be an inverse function of the pressure in that space, the pump may be deemed a positive displacement pump because of the fact that it reciprocates over a fairly well defined stroke.

Figure 3:
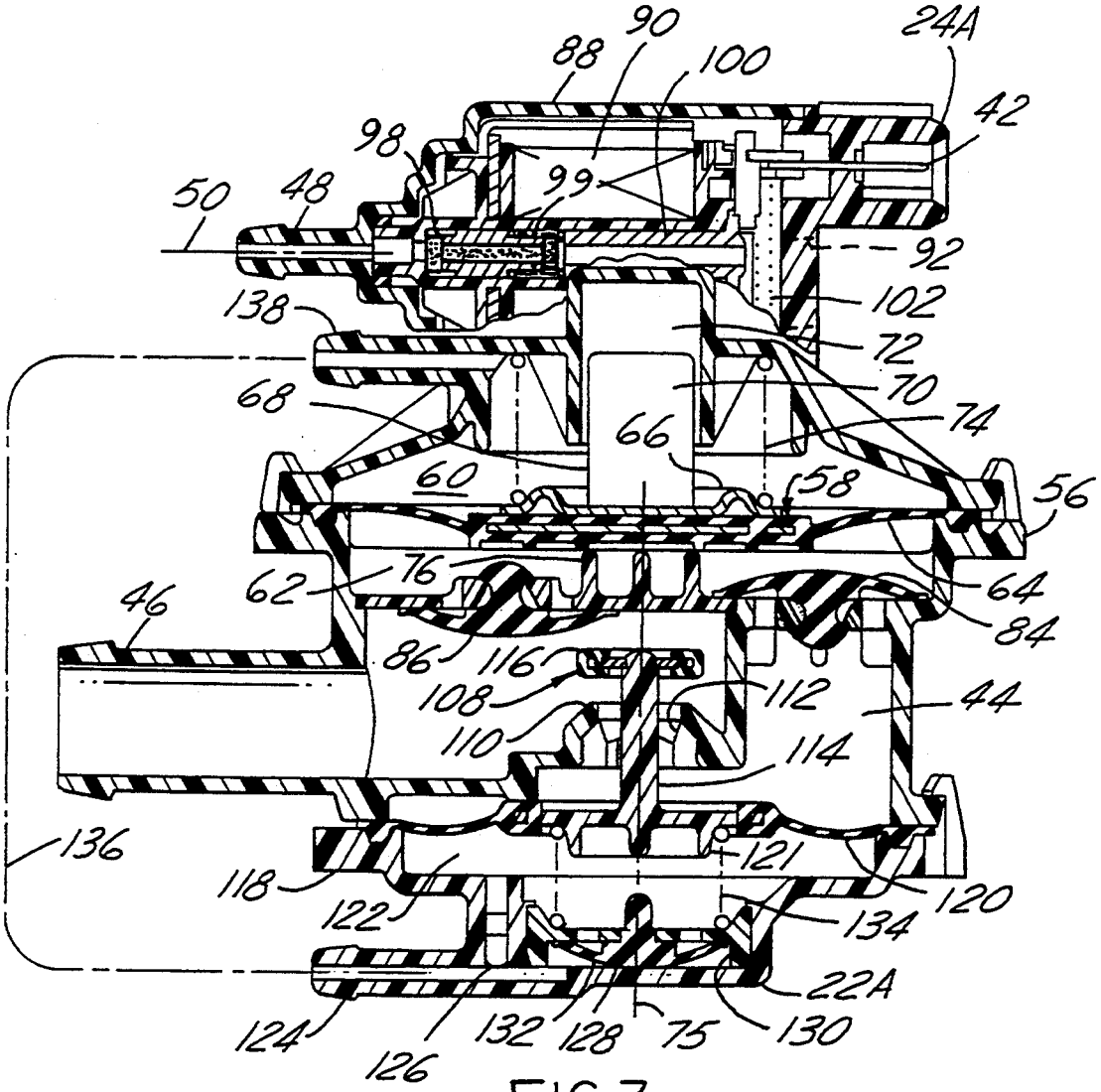
FIG. 3 is a view similar to FIG. 2, illustrating another embodiment.

FIG. 3 depicts another embodiment of pump 24A. Like reference numerals are used to designate the same parts in FIG. 3 that were previously described in connection with FIG. 2, and in the interest of brevity a detailed description of such parts will not be repeated. While there may be certain constructional differences in certain parts of the two Figs. that are nevertheless designated by like numerals, such constructional differences do not alter the basic operation of pump 24A from that which was described for pump 24.

The principal difference between pumps 24 and 24A is that pump 24A contains an integral canister vent valve (CVV) 22A instead of a separate CW valve 22. CVS valve 22A comprises a valve 108 that is arranged for co-action with a valve seat 110 formed in an internal housing wall. FIG. 3 shows valve 108 unseated from seat 110 so that outlet port 46 has fluid communication with inlet port 44 through an internal passageway 112 which is circumscribed at one end by seat 110.

Valve 108 includes a stem 114 passing from a valve head 116 to a vacuum actuator mechanism 118. Vacuum actuator mechanism 118 comprises a diaphragm 120 to which a diametrically enlarged base 121 of stem 114 is centrally attached in a sealed manner. The outer peripheral margin of diaphragm 120 is captured in a sealed manner between two of the housing parts. Diaphragm 120 separates inlet port 44 from a control chamber space 122. Control chamber space 122 in turn is communicated with a nipple 124 by the parallel combination of a bleed orifice 126 and a check valve assembly 128.

Check valve assembly 128 is a one-way valve similar to the one-way valves previously described. It comprises a relatively rigid body member 130 on which an umbrella valve element 132 is mounted. The valve assembly is disposed in a mounting in a wall of one of the housing parts so as to be disposed directly below stem base 121. A helical coil spring 134 is disposed between body 130 and stem base 121, as shown, such that valve 108 is biased to the illustrated open condition. Nipple 124 is communicated by a conduit 136 to another nipple 138 that leads to vacuum chamber space 60.

During those times that the diagnostic procedure is not being performed, valve 108 is maintained open so that the evaporative emission space is vented to atmosphere through outlet port 46, passage 112, and inlet port 44. When a diagnostic procedure is performed, the application of vacuum to chamber space 60 due to energization of solenoid 90 concurrently causes vacuum to be applied to nipple 124. Assuming that chamber space 122 is initially at atmospheric pressure, the application of vacuum to nipple 124 creates a pressure differential across valve 128 causing the valve to open immediately. As a result, vacuum is drawn in chamber space 122 causing diaphragm 120 to be displaced downwardly to close valve head 116 against valve seat 110 thereby terminating fluid communication between inlet port 44 and outlet port 46 via passage 112. Thus, vent valve 22A is promptly closed at the beginning of a diagnostic procedure.

At the conclusion of a compression stroke of movable wall 58, solenoid 90 is de-energized, immediately venting chamber space 60 to atmosphere. Because of the communication of that chamber space to nipple 124, atmospheric pressure is immediately transmitted to nipple 124. This in turn causes valve element 132 to forthwith close, and orifice 126 to commence bleeding air into chamber space 122 from nipple 124. Orifice 126 is sized such that the amount of bleed air that can pass into chamber space 122 before the pump's next compression stroke is insufficient to re-open valve 108 before solenoid 90 is once again energized. In this way, valve 108 remains closed during an entire diagnostic procedure because orifice 126 acts to maintain sufficient vacuum in chamber space 122 for the longest expected time between consecutive operations of reed switch 106 from closed to open during pump reciprocation. At the conclusion of a diagnostic procedure, sufficient air will bleed into chamber space 122 to cause valve 108 to reopen. The pumping action of pump 24A for pressurizing the evaporative emission space is the same as that described for pump 24.

Figure 4:
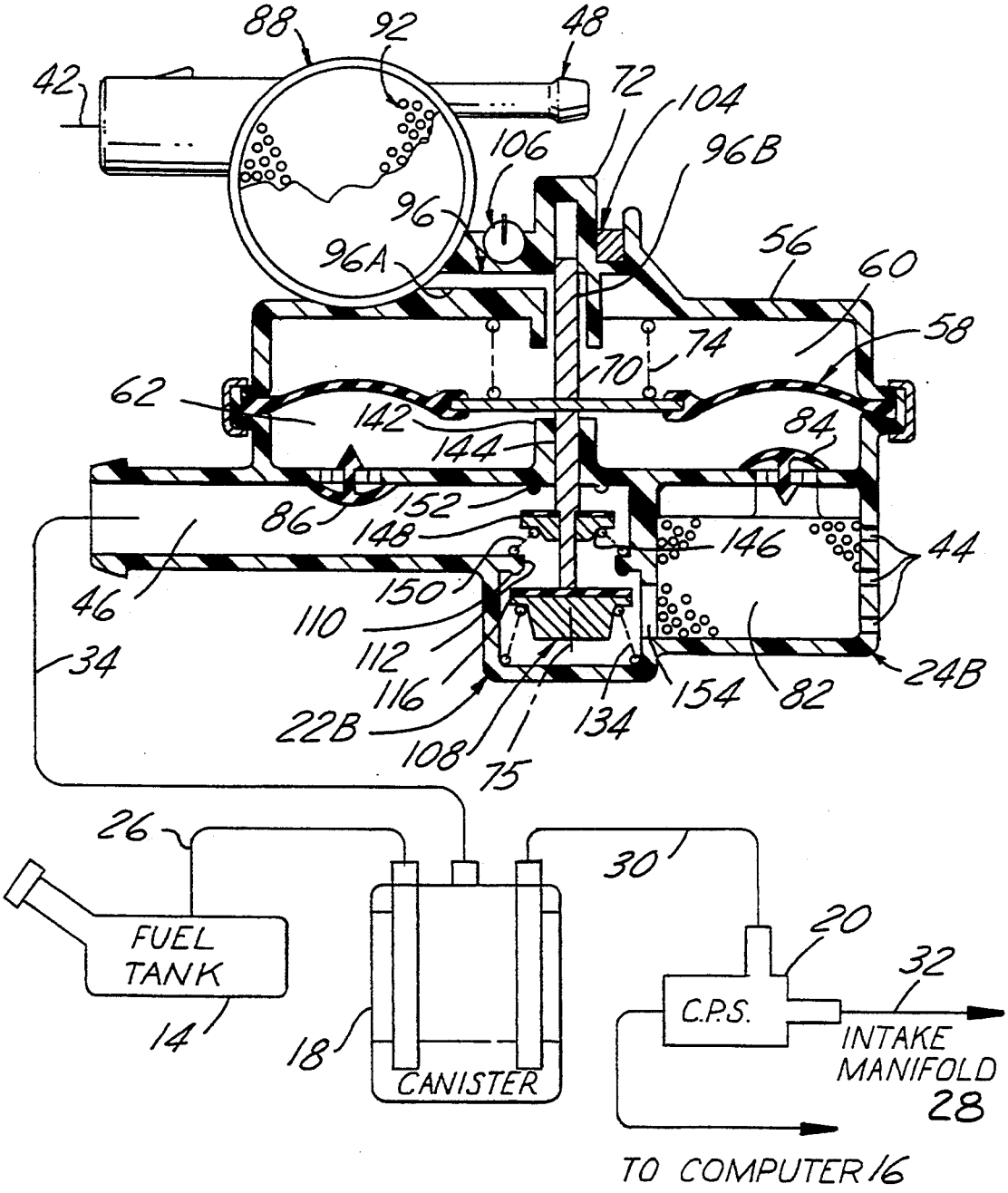
FIG. 4 is a view similar to FIG. 2, illustrating yet another embodiment.

FIG. 4 illustrates a third embodiment of pump 24B and once again its parts that correspond to parts previously described, although possibly differing in constructional details, are identified by the same reference numerals, and they will not be re-described in detail. Pump 24B also incorporates an integral vent valve 22B but in a different manner from the incorporation of vent valve 22A in pump 24A.

In pump 24B, passageway 96 is seen to comprise a horizontal segment 96A leading from valve 88 to axial slots 96B formed in the sidewall of sleeve 72. A cylindrical guide sleeve 142 is fashioned in a wall of housing 56 that defines the bottom of chamber space 62, A cylindrical shaft 144 that is coaxial with, but unattached to, movable wall 58 is guided for motion along axis 75 by guide sleeve 142. Disposed on a central portion of shaft 144 is an annulus 146 whose upper face contains an elastomeric (rubber) annular seal 148. A spring 150 acts between a wall portion of housing 56 and annulus 146 to resiliently urge the shaft/annulus 144, 146 upwardly so that at least for the position shown in FIG. 4, the upper end of shaft 144 bears against the center of movable wall 58. In this position, seal 148 is spaced somewhat below a circular lip 152 that is in surrounding relation to the opening in sleeve 142 through which shaft 144 passes and that confronts seal 148. Valve 108 is disposed in a compartment of housing 56 below shaft 144, and in this same position, spring 134 biases valve 108 upwardly such that the center part of valve head 116 bears resiliently against the lower end of shaft 144, and the valve head is spaced somewhat below seat 110. Laterally adjacent the compartment which contains valve 108 is the air inlet port 44, containing filter 82. There is a hole 154 in the wall between the compartment and the filter so that ambient air can pass from the several small openings forming the entrance of the inlet port, through filter 82, through hole 154, through the compartment containing valve 108, through passage 112, and to outlet port 46, when the pump and vent valve are in the position shown in FIG. 4. This position then represents the venting position wherein the canister vent port is vented to atmosphere because vent valve 22B is open.

When pump 24B operates, vent valve 22B is closed, and the pump pumps air into the evaporative emission space in the same manner as described for pumps 24 and 24A. Vent valve 22B closes in the following manner. When valve 88 is operated to apply vacuum to chamber space 60, movable wall 58 executes upward motion in the direction of an intake stroke. Its upward motion is arrested by abutment with the lower end of sleeve 72. As movable wall 58 moves upwardly, both springs. 134 and 150 urge valve 108 and shaft 144 upwardly in unison so that shaft 144 follows the movable wall until valve head 116 abuts seat 110 to close passage 112 between ports 46 and 44. Thereafter spring 150 keeps shaft 144 following the movable wall until seal 148 abuts lip 152. Thereafter the movable wall continues until it reaches its upper limit stop. The abutment of seal 148 with lip 152 prevents leakage from chamber space 62 to outlet port 46 through clearance that exists between shaft 144 and sleeve 72. The force exerted by spring 134 is sufficiently large to keep valve 108 closed for the range of possible pressure differentials between outlet port and inlet port 44.

Magnet 104 and reed switch 106 are disposed relative to the upper end of shaft 70 such that on a compression stroke of the pump, reed switch 106 operates from closed to open to reverse the motion of movable wall 58, thus commencing an intake stroke, before movable wall 58 can push shaft 144 downwardly to unseat either seal 148 or valve head 116 so that both remain sealed closed during the compression/intake reciprocation of the pump mechanism.

When valve 88 is operated to terminate the reciprocation of pump 24B, chamber 60 is once again vented to atmosphere. Consequently, movable wall 58 is forced downwardly to engage shaft 144. The force exerted by spring 74 is sufficiently large that it causes movable wall 58 to push shaft 144 downwardly, compressing both springs 150 and 134 in the process, and thus unseating seal 148 from lip 152 and opening vent valve 22B.

Figure 5:
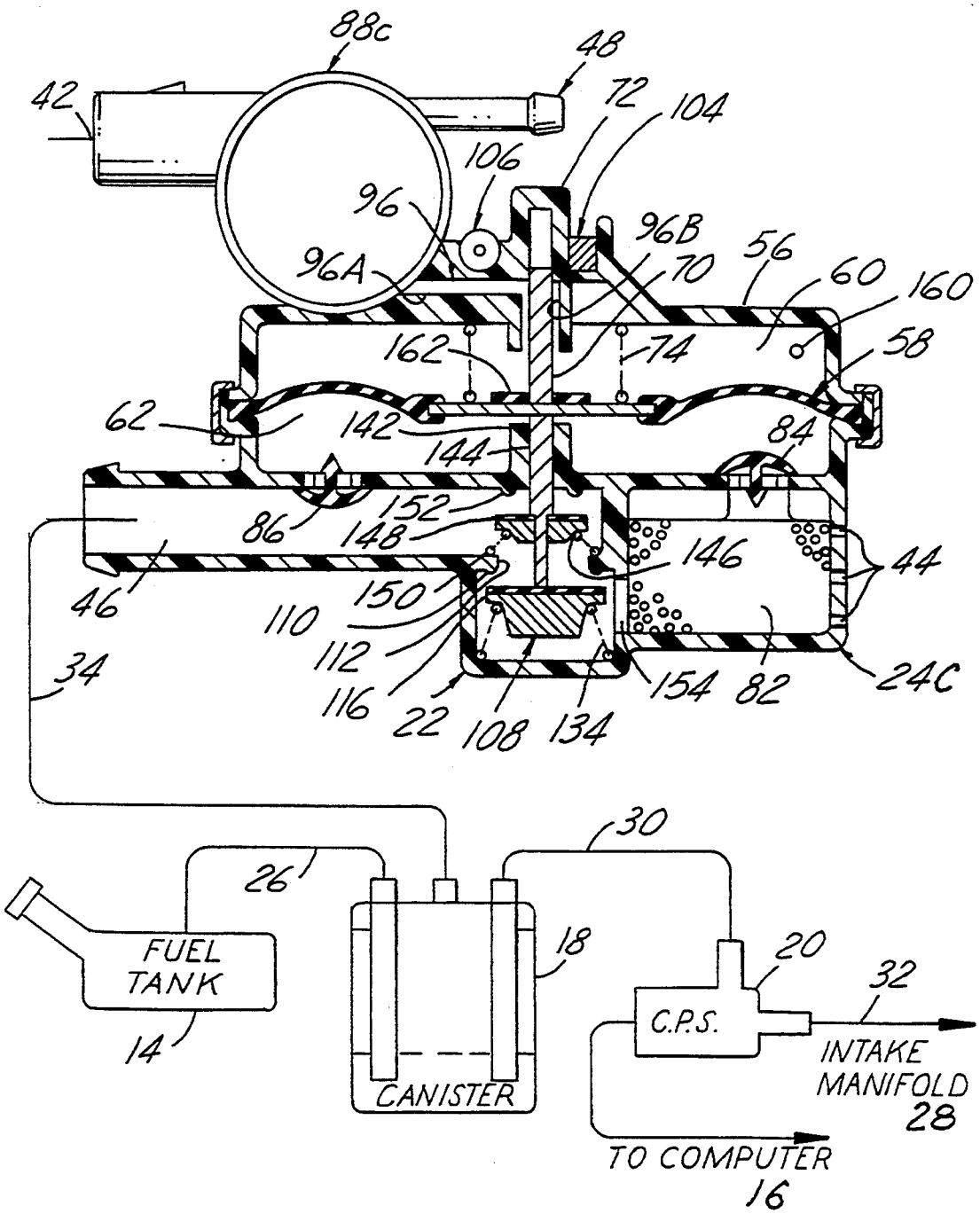
FIG. 5 is a view similar to FIG. 4, illustrating still another embodiment.

FIG. 5 depicts a pump 24C that is exactly like the one of FIG. 4 except in the following respects. Instead of a three-port solenoid valve 88, pump 24C has a two-port solenoid valve 88C, comprising only a vacuum port and an outlet port. Chamber space 60 is continually vented to atmosphere through an orifice 160 in a portion of the housing wall bounding chamber space 60. When the solenoid of valve 88C is not energized, chamber space 60 is closed to the outlet of valve 88C, and for a sufficiently long existence of that condition, the pressure in chamber space 60 will stabilize at atmospheric pressure due to venting through orifice 160. When valve 88C is energized, vacuum is introduced into chamber space 60 to draw movable wall against its upper limit stop since the orifice 160 is merely a bleed that prevents immediate dissipation of the drawn vacuum. The face of movable wall 58 that is toward sleeve 72 contains a circular annular seal 162 circumferentially bounding shaft 70 so that as the movable wall comes to abutment with the lower end of the sleeve, chamber space 60 is closed off from the vacuum source. While this serves to limit the amount of vacuum that is drawn in chamber space 60, and while orifice 160 imposes a continuous atmospheric bleed, the net effect is to maintain movable wall 58 at its upper limit of travel until such time as solenoid valve 88C is de-energized.

When such de-energization occurs, the drawn vacuum dissipates by bleeding through orifice 160 so that the pressure in chamber space 60 returns to atmospheric. As a result, equal fluid pressures are created on opposite sides of movable wall 58 so that the net force acting on it is essentially that of solely spring 74. The spring thus forces the movable wall to execute a compression stroke. Upon reed switch 106 opening and computer 16 once again energizing valve 88C, the compression stroke is terminated, and followed by an intake stroke. This process repeats until a point is reached in the procedure when the computer commands no further energization of valve 88C, at which time the bleed will dissipate the vacuum in chamber space 60 so that the pump returns to the condition depicted in FIG. 5.

Figure 6:
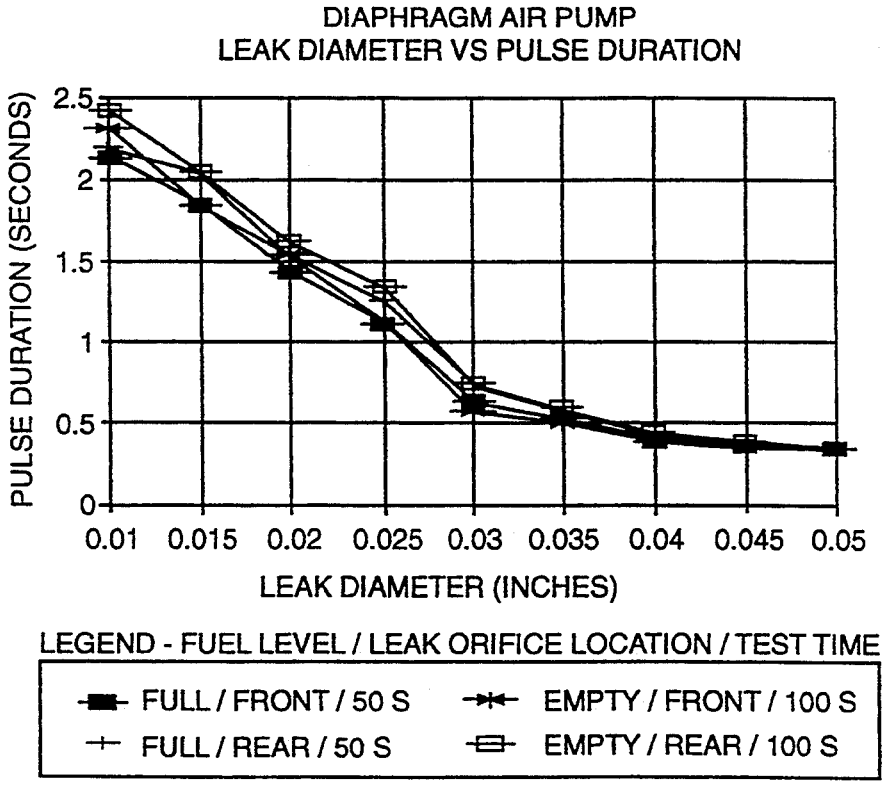
FIG. 6 is a graph plot useful in appreciating some of the benefit that can be derived from using the present invention.

FIG. 6 is a typical graph plot illustrating how the present invention can provide a measurement of leakage. The horizontal axis represents a range of effective leak diameters, and the vertical axis, a range of pulse durations. In the case of the pumps that have been described, pulse duration would be defined as the time between consecutive actuations of reed switch 106 from closed to open, but it can be defined in other ways that are substantially equivalent to this way or that provide substantially the same information. The graph plot contains four graphs each of which represents pulse duration as a function of leak diameter for a particular combination of three test conditions, such three conditions being fuel level in the tank, location of an intentionally created leak orifice, and the duration of the test. As one can see, the four graphs closely match each other, proving that a definite relationship exists for the invention to provide a reasonably accurate measurement of leakage, even down to sizes that have quite a small effective orifice diameter. This measurement capability enables the engine management computer, or any other on-board data recorder, to log results of individual tests and thereby create a test history that may be useful for various purposes. The memory of the computer may be used as an indicating means to log the test results. The automobile may also contain an indicating means that draws the attention of the driver to the test results, such an indicating means being an instrument panel display. If a diagnostic procedure indicates that the evaporative emission system has integrity, it may be deemed unnecessary for the result to be automatically displayed to the driver; in other words, automatic display of a test result may be given to the driver only in the event of an indication of non-integrity. A test result may be given in the form of an actual measurement and/or a simple indication of integrity or non-integrity.

Because of the ability of the pump to provide measurement of the effective orifice size of leakage, it may be employed to measure the performance of CPS valve 20 and flow through the system at the end of the diagnostic procedure that has already been described herein. One way to accomplish this is for computer 16 to deliver a signal commanding a certain opening of CPS valve 20, thus creating what amounts to an intentionally introduced leak. If the CPS valve responds faithfully, the pump will reciprocate at a rate corresponding substantially to the amount of CPS valve opening that has been commanded. If there is a discrepancy, it will be detected by the computer, and an appropriate indication may be given. If no discrepancy is detected, that is an indication that the CPS valve and the system are functioning properly.

While a presently preferred embodiment of the invention has been illustrated and described, it should be appreciated that principles are applicable to other embodiments that fall within the scope of the following claims. An example of such an embodiment could comprise an electric actuator to stroke the movable wall. Of course, any particular embodiment of the invention for a particular usage is designed in accordance with established engineering calculations and techniques, using materials suitable for the purpose.

What is claimed is:

1. An automotive vehicle comprising an internal combustion engine and a fuel system for said engine which comprises a fuel tank for storing volatile liquid fuel for the engine and an evaporative emission control system which comprises a collection canister that in cooperative combination with head space of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion chamber space of the engine and ensuing combustion in said combustion chamber space, valve means via which said evaporative emission space is selectively communicated to atmosphere, said vehicle further comprising means, including pump means, for distinguishing between integrity and non-integrity of said evaporative emission control system, under conditions conducive to obtaining a reliable distinction between such integrity and non-integrity, against leakage of volatile fuel vapor from that portion thereof which includes said tank, said canister, said valve means, and said canister purge valve, characterized in that said pump means comprises a positive displacement reciprocating pump having a mechanism that, while said valve means is closed to prevent communication of said evaporative emission space to atmosphere and while said canister purge valve is closed to prevent communication of said evaporative emission space to said intake manifold, executes reciprocating motion comprising an intake stroke and a compression stroke and that comprises means to intake air during each occurrence of the intake stroke for creating a measured charge volume of air at given pressure and means to compress said measured charge volume of air to pressure greater than such given pressure and force a portion thereof into said evaporative emission space on each occurrence of the compression stroke wherein said means to compress said measured charge volume of air to pressure greater than such given pressure and force a portion thereof into said evaporative emission space on each occurrence of the compression stroke comprises mechanical spring means to which energy is imparted during an intake stroke and which releases energy during a compression stroke.

2. An automotive vehicle comprising an internal combustion engine and a fuel system for said engine which comprises a fuel tank for storing volatile liquid fuel for the engine and an evaporative emission control system which comprises a collection canister that in cooperative combination with head space of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion chamber space of the engine and ensuing combustion in said combustion chamber space, valve means via which said evaporative emission space is selectively communicated to atmosphere, said vehicle further comprising means, including pump means, for distinguishing between integrity and non-integrity of said evaporative emission control system, under conditions conducive to obtaining a reliable distinction between such integrity and non-integrity, against leakage of volatile fuel vapor from that portion thereof which includes said tank, said canister, said valve means, and said canister purge valve, characterized in that said pump means comprises a positive displacement reciprocating pump having a mechanism that, while said valve means is closed to prevent communication of said evaporative emission space to atmosphere and while said canister purge valve is closed to prevent communication of said evaporative emission space to said intake manifold, executes reciprocating motion comprising an intake stroke and a compression stroke and that comprises means to intake air during each occurrence of the intake stroke for creating a measured charge volume of air at given pressure and means to compress said measured charge volume of air to pressure greater than such given pressure and force a portion thereof into said evaporative emission space on each occurrence of the compression stroke, and characterized further in that said positive displacement reciprocating pump comprises a housing that is divided by a movable wall into an air pumping chamber space and a vacuum chamber space, inlet means including a one-way valve communicating an inlet of said air pumping chamber space to atmosphere such that air can enter, but not exit, said air pumping chamber space via said inlet means, outlet means including a second one-way valve communicating an outlet of said air pumping chamber space to said evaporative emission space such that air can exit, but not enter, said air pumping chamber space via said outlet means, said pump further comprising a mechanical spring that acts on said movable wall in a sense urging said movable wall to compress air in said air pumping chamber space, and means for repeatedly causing said vacuum chamber space to be alternately communicated to intake manifold vacuum and to atmosphere such that during communication of said vacuum chamber space to intake manifold vacuum, said movable wall executes an intake stroke against force exerted thereon by said mechanical spring to draw air from atmosphere into said air pumping chamber space through said inlet means, and during communication of said vacuum chamber space to atmosphere, said mechanical spring forces said movable wall to execute a compression stroke to force some of the air from said air pumping chamber space through said outlet means into said evaporative emission space.

3. An automotive vehicle as set forth in claim 2 characterized further in that said spring is disposed in said vacuum chamber space, and in that said housing comprises a limit stop disposed within said vacuum chamber space for co-action with said movable wall to define a limit for the end of an intake stroke of said movable wall.

4. An automotive vehicle as set forth in claim 3 characterized further by guide means guiding a central region of said movable wall for straight line motion as it executes intake and compression strokes, and by sensor means disposed proximate said guide means for sensing position of said central region of said movable wall along the direction of such straight line motion.

5. An automotive vehicle as set forth in claim 4 characterized further in that said sensor means comprises a switch that is disposed to switch between switch conditions when said central region of said movable wall is at a particular location proximate the end of the compression stroke and the beginning of the intake stroke.

6. An automotive vehicle as set forth in claim 5 characterized further by means for distinguishing between integrity and non-integrity comprising detecting means detecting the duration between consecutive occurrences of said switch operating from one particular switch condition to another particular switch condition; and utilization means utilizing the detected duration between consecutive occurrences of said switch operating from said one particular switch condition to said another particular switch condition.

7. An automotive vehicle comprising an internal combustion engine and a fuel system for said engine which comprises a fuel tank for storing volatile liquid fuel for the engine and an evaporative emission control system which comprises a collection canister that in cooperative combination with head space of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion chamber space of the engine and ensuing combustion in said combustion chamber space, valve means via which said evaporative emission space is selectively communicated to atmosphere, said vehicle further comprising means, including pump means, for distinguishing between integrity and non-integrity of said evaporative emission control system, under conditions conducive to obtaining a reliable distinction between such integrity and non-integrity, against leakage of volatile fuel vapor from that portion thereof which includes said tank, said canister, said valve means, and said canister purge valve, characterized in that said pump means comprises a positive displacement reciprocating pump having a mechanism that, while said valve means is closed to prevent communication of said evaporative emission space to atmosphere and while said canister purge valve is closed to prevent communication of said evaporative emission space to said intake manifold, executes reciprocating motion comprising an intake stroke and a compression stroke and that comprises means to intake air during each occurrence of the intake stroke for creating a measured charge volume of air at given pressure and means to compress said measured charge volume of air to pressure greater than such given pressure and force a portion thereof into said evaporative emission space on each occurrence of the compression stroke, and characterized further in that a sensor means is disposed to sense the execution of predetermined travel of said mechanism along a compression stroke, and in that means responsive to said sensor means causes said mechanism to execute an intake stroke upon said sensor means sensing such execution of predetermined travel of said mechanism along said compression stroke.

8. An automotive vehicle as set forth in claim 7 characterized further in that said means for distinguishing between integrity and non-integrity comprises detecting means for detecting the duration between consecutive occurrences of said sensor means sensing the execution of predetermined travel of said mechanism along a compression stroke, and utilization means utilizing the detected duration between consecutive occurrences of said sensor means sensing the execution of predetermined travel of said mechanism along a compression stroke.

9. An automotive vehicle as set forth in claim 8 characterized further in that said sensor means comprises a switch that is disposed to switch from one particular switch condition to another particular switch condition upon sensing the execution of predetermined travel of said mechanism along a compression stroke, and said utilization means comprises means for utilizing the detected duration between consecutive occurrences of said switch operating from said one particular switch condition to said another particular switch condition to operate an indicator means.

10. An automotive vehicle as set forth in claim 9 characterized further in that said pump mechanism comprises a mechanical spring that exerts force on a movable member to cause said movable member to compress said measured charge volume of air during a compression stroke.

11. An automotive vehicle as set forth in claim 7 characterized further in that said pump mechanism comprises a mechanical spring that exerts force on a movable member to compress said measured charge volume of air during a compression stroke.

12. An automotive vehicle comprising an internal combustion engine and a fuel system for said engine which comprises a fuel tank for storing volatile liquid fuel for the engine and an evaporative emission control system which comprises a collection canister that in Cooperative combination with head space of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion chamber space of the engine and ensuing combustion in said combustion chamber space, valve means via which said evaporative emission space is selectively communicated to atmosphere, said vehicle further comprising means, including pump means, for distinguishing between integrity and non-integrity of said evaporative emission control system, under conditions conducive to obtaining a reliable distinction between such integrity and non-integrity, against leakage of volatile fuel vapor from that portion thereof which includes said tank, said canister, said valve means, and said canister purge valve, characterized in that said pump means comprises a positive displacement reciprocating pump having a mechanism that, while said valve means is closed to prevent communication of said evaporative emission space to atmosphere and while said canister purge valve is closed to prevent communication of said evaporative emission space to said intake manifold, executes reciprocating motion comprising an intake stroke and a compression stroke and that comprises means to intake air during each occurrence of the intake stroke for creating a measured charge volume of air at given pressure and means to compress said measured Charge volume of air to pressure greater than such given pressure and force a portion thereof into said evaporative emission space on each occurrence of the Compression stroke, and characterized further in that said mechanism comprises a movable member that executes intake and compression strokes and in that said pump comprises a limit stop disposed for coaction with said movable member to define a final limit for an intake stroke, by means for causing said movable member to occupy the final limit of an intake stroke for an amount of time that is slightly more than sufficient to assure that a measured charge volume of air at atmosphere pressure will be created before the execution of an ensuing compression stroke, and in that a sensor means is disposed to sense execution of predetermined travel of said movable member along a compression stroke, and in that means responsive to said sensor means causes said movable member to execute an intake stroke upon said sensor means sensing execution of predetermined travel of said movable member along a compression stroke from a final limit of an intake stroke.

13. An automotive vehicle as set forth in claim 12 characterized further in that said pump mechanism comprises a mechanical spring that exerts force on a movable member to compress said measured charge volume of air during a compression stroke.

14. An automotive vehicle comprising an internal combustion engine and a fuel system for said engine which comprises a fuel tank for storing volatile liquid fuel for the engine and an evaporative emission control system which comprises a collection canister that in cooperative combination with head space of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion chamber space of the engine and ensuing combustion in said combustion chamber space, valve means via which said evaporative emission space is selectively communicated to atmosphere, said vehicle further comprising means, including pump means, for distinguishing between integrity and non-integrity of said evaporative emission control system, under conditions conducive to obtaining a reliable distinction between such integrity and non-integrity, against leakage of volatile fuel vapor from that portion thereof which includes said tank, said canister, said valve means, and said canister purge valve, characterized in that said pump means comprises a positive displacement reciprocating pump having a mechanism that, while said valve means is closed to prevent communication of Said evaporative emission space to atmosphere and while said canister purge valve is closed to prevent communication of said evaporative emission space to said intake manifold, executes reciprocating motion comprising an intake stroke and a compression stroke and that comprises means to intake air during each occurrence of the intake stroke for creating a measured charge volume of air at given pressure and means to compress said measured charge volume of air to pressure greater than such given pressure and force a portion thereof into said evaporative emission space on each occurrence of the compression stroke, and characterized further in that said positive displacement reciprocating pump comprises a housing that is divided by a movable wall into an air pumping chamber space and a vacuum chamber space, inlet means including a one-way valve communicating an inlet of said air pumping chamber space to atmosphere such that air can enter, but not exit, said air pumping chamber space via said inlet means, outlet means including a second one-way valve communicating an outlet of said air pumping chamber space to said evaporative emission space such that air can exit, but not enter, said air pumping chamber space via said outlet means, and said valve means comprises a vent valve having a vent valve inlet in fluid communication with said outlet means at a location between said evaporative emission space and the one-way valve of said outlet means and a vent valve outlet in fluid communication with said inlet means at a location between atmosphere and the one-way valve of said inlet means.

15. An automotive vehicle as set forth in claim 14 characterized further in that said pump further comprises a mechanical spring that acts on said movable wall in a sense urging said movable wall to compress air in said air pumping chamber space, and means for repeatedly causing said vacuum chamber space to be alternately communicated to intake manifold vacuum and to atmosphere Such that during communication of said vacuum chamber space to intake manifold vacuum, said movable wall executes an intake stroke against force exerted thereon by said mechanical spring to draw air from atmosphere into said air pumping chamber space through said inlet means, and during communication of said vacuum chamber space to atmosphere, said mechanical spring forces said movable wall to execute a compression stroke to force some of the air from said air pumping chamber space through said outlet means into said evaporative emission space, spring means resiliently biasing said vent valve open, and vacuum actuator means including a check valve and an orifice fluidly connected in parallel with each other between said vacuum chamber space and a vacuum actuator of said vacuum actuator means such that when vacuum is applied to said vacuum chamber space, it is concurrently applied to said vacuum actuator to cause said vent valve to immediately close, and to cause vacuum sufficient to keep said vent valve closed to continue to be applied to said vacuum actuator for a certain amount of time after vacuum ceases to be applied to said vacuum chamber space.

16. An automotive vehicle comprising an internal combustion engine and a fuel system for said engine which comprises a fuel tank for storing volatile liquid fuel for the engine and an evaporative emission control system which comprises a collection canister that in cooperative combination with head space of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion Chamber space of the engine and ensuing combustion in said combustion chamber space, valve means via which said evaporative emission space is selectively communicated to atmosphere, said vehicle further comprising means, including pump means, for distinguishing between integrity and non-integrity of said evaporative emission control system, under conditions conducive to obtaining a reliable distinction between such integrity and non-integrity, against leakage of volatile fuel vapor from that portion thereof which includes said tank, said canister, said valve means, and said canister purge valve, characterized in that said pump means comprises a positive displacement reciprocating pump having a mechanism that, while said valve means is closed to prevent communication of said evaporative emission space to atmosphere and while said canister purge valve is closed to prevent communication of said evaporative emission space to said intake manifold, executes reciprocating motion comprising an intake stroke and a compression stroke and that comprises means to intake air during each occurrence of the intake stroke for creating a measured charge volume Of air at given pressure and means to compress said measured charge volume of air to pressure greater than such given pressure and force a portion thereof into said evaporative emission space on each occurrence of the compression stroke, and characterized further in that said valve means comprises a vent valve that is integrally associated with said pump by being disposed to selectively open and close a passage extending between an inlet port of said pump and an outlet port of said pump.

17. An automotive vehicle comprising an internal combustion engine and a fuel system for said engine which comprises a fuel tank for Storing volatile liquid fuel for the engine and an evaporative emission control system which comprises a Collection canister that in cooperative combination with head space of said tank cooperatively defines an evaporative emission space wherein fuel vapors generated from the volatilization of fuel in said tank are temporarily confined and collected Until periodically purged by means of a canister purge valve to an intake manifold of the engine for entrainment with induction flow of combustible mixture into combustion chamber space of the engine and ensuing combustion in said combustion chamber space, valve means via which said evaporative emission space is selectively communicated to atmosphere, said vehicle further comprising means, including pump means, for distinguishing between integrity and non-integrity of said evaporative emission control system, under conditions conducive to obtaining a reliable distinction between such integrity and non-integrity, against leakage of volatile fuel vapor from that portion thereof which includes said tank, said canister, said valve means, and said canister purge valve, characterized in that said pump means comprises a positive displacement reciprocating pump having a mechanism that, while said valve means is closed to prevent communication Of said evaporative emission space to atmosphere and while said canister purge valve is closed to prevent communication of said evaporative emission Space to said intake manifold, executes reciprocating motion comprising an intake stroke and a compression stroke and that comprises means to intake air during each occurrence of the intake stroke for creating a measured charge volume of air at given pressure and means to compress said measured charge volume of air to pressure greater than such given pressure and force a portion thereof into said evaporative emission space on each occurrence of the compression stroke, and characterized further in that said positive displacement reciprocating pump comprises a housing that is divided by a movable wall into an air pumping chamber space and a vacuum chamber space, a one-way valve through which said inlet port communicates with said air pumping chamber space such that air can enter, but not exit, said air pumping chamber space via said inlet port, a second one-way valve through which said outlet port communicates with said air pumping chamber space such that air can exit, but not enter, said air pumping chamber space via said outlet port, said pump further comprising a mechanical spring that acts on said movable wall in a sense urging said movable wall to compress air in said air pumping chamber space, means for repeatedly causing said vacuum chamber space to be alternately communicated to intake manifold vacuum and to atmosphere such that during communication of said vacuum chamber space to intake manifold vacuum, said movable wall executes an intake stroke against force exerted thereon by said mechanical spring to draw air from atmosphere into said air pumping chamber space through said inlet port and first one-way valve, and during communication of said vacuum chamber space to atmosphere, said mechanical spring forces said movable wall to execute a compression stroke to force some of the air from said air pumping chamber space through said second one-way valve and said outlet port into said evaporative emission space, and said vacuum chamber space is in communication with a vacuum actuator for operating said vent valve such that when vacuum is delivered to said vacuum chamber space, it is also conveyed to said vacuum actuator to cause said vent valve to close.

18. An automotive vehicle as set forth in claim 17 characterized further in that vacuum is conducted to said vacuum actuator via the parallel combination of an orifice and a third one-way valve organized and arranged such that said third one-way valve allows vacuum to pass into, but not from, said vacuum actuator whereby vacuum is promptly conveyed to said vacuum actuator when said vacuum chamber space is communicated to vacuum, but is delayed in leaving said vacuum actuator when said vacuum chamber space is communicated to atmosphere.

19. An automotive vehicle comprising an internal combustion engine and a fuel system for said engine which comprises a fuel tank for storing volatile liquid fuel for the engine and an evaporative emission control system which comprises a collection canister that in cooperative combination with headspace of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion chamber space of the engine and ensuing combustion in said combustion chamber space, valve means via which said evaporative emission space is selectively communicated to atmosphere, said Vehicle further comprising means, including pump means, for distinguishing between integrity and non-integrity of said evaporative emission space against leakage of volatile fuel vapor from that portion thereof which includes said tank, said canister, said valve means, and said canister purge valve, under conditions conducive to obtaining a reliable distinction between such integrity and non-integrity, by creating in said evaporative emission space a pressure that is significantly different from ambient atmospheric pressure, characterized in that said pump means is powered by vacuum that is derived from engine intake manifold vacuum and that is selectively communicated to said pump means by an selectively operable, electrically operated valve.

20. An automotive vehicle as set forth in claim 19 characterized further in that said pump means comprises a mechanism that executes reciprocating motion comprising an intake stroke and a compression stroke and that comprises means to intake air during each occurrence of the intake stroke for creating a measured charge volume of air at given pressure and means to compress said measured charge volume of air and force a portion thereof into said evaporative emission space on each occurrence of the compression stroke both while said valve means is closed to prevent communication of said evaporative emission space to atmosphere and while said canister purge valve is closed to prevent communication of said evaporative emission space to said intake manifold.

21. An automotive vehicle as set forth in claim 20 characterized further in that said pump means comprises a housing that is divided by a movable wall into an air pumping chamber space and a vacuum chamber space, inlet means including a one-way valve communicating an inlet of said air pumping chamber space to atmosphere such that air can enter, but not exit, said air pumping chamber space via said inlet means, outlet means including a second one-way valve communicating an outlet of said air pumping chamber space to said evaporative emission space such that air can exit, but not enter, said air pumping chamber space via said outlet means, said pump means further comprising a mechanical spring that acts on said movable wall in a sense urging said movable wall to compress air in said air pumping chamber space, and said selectively operable, electrically operated valve comprises means for repeatedly causing said vacuum chamber space to be alternately communicated to intake manifold vacuum and to atmosphere such that during communication of said vacuum chamber space to intake manifold vacuum, said movable wall executes an intake stroke against force exerted thereon by said mechanical spring to draw air from atmosphere into said air pumping chamber space through said inlet means, and during communication of said vacuum chamber space to atmosphere, said mechanical spring forces said movable wall to execute a compression stroke to force some of the air from said air pumping chamber space through said outlet means into said evaporative emission space.

22. A method for distinguishing between integrity and non-integrity of an evaporative emission control system of an internal combustion engine powered automotive vehicle having a fuel tank for storing volatile liquid fuel for the engine, said evaporative emission control system comprising a collection canister that in cooperative combination with headspace of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion chamber space of the engine and ensuing combustion in said combustion chamber space, and valve means via which said evaporative emission space is selectively communicated to atmosphere, said method characterized by closing both said valve means and said canister purge valve, and while they are closed, creating in said evaporative emission space by means of a reciprocating pump a pressure that is significantly different from atmospheric pressure, measuring the duration between reciprocations of said pump, and utilizing such measured duration to distinguish between integrity and non-integrity of said evaporative emission control system.

23. A method as set forth in claim 22 characterized further in that the measuring step comprises measuring the duration between consecutive reciprocations of said pump.

24. A method for distinguishing between integrity and non-integrity of an evaporative emission control system of an internal combustion engine powered automotive vehicle having a fuel tank for storing volatile liquid fuel for the engine, said evaporative emission control system comprising a collection canister that in cooperative combination with headspace of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion chamber space of the engine and ensuing combustion in said combustion chamber space, and valve means via which said evaporative emission space is selectively communicated to atmosphere, said method characterized by closing both said valve means and said canister purge valve, and while they are closed, creating in said evaporative emission space pressure that is significantly different from atmospheric pressure under conditions conducive to obtaining a reliable distinction between such integrity and non-integrity, wherein the step of creating pressure in said evaporative emission space that is significantly different from atmospheric pressure comprises operating a pump that comprises a vacuum chamber space, an air pumping chamber space, a movable wall separating said vacuum chamber space from said air pumping chamber space, and mechanical spring means that acts on said movable wall, by communicating vacuum derived from engine intake manifold vacuum to said vacuum chamber space to draw vacuum in said vacuum chamber space that causes said movable wall to execute an intake stroke that causes a measured charge of atmospheric air to be drawn in said air pumping chamber space and energy to be imparted to said mechanical spring means, and then venting the vacuum in said vacuum chamber space to allow said mechanical spring means to release energy and cause said movable wall to execute a compression stroke that compresses said measured charge of atmospheric air in said air pumping chamber space and forces a portion thereof into said evaporative emission space.

25. A pump for use in distinguishing between integrity and nonintegrity of an evaporative emission control system of an internal combustion engine powered automotive vehicle, said pump comprising a housing having inlet means for communication with atmosphere and outlet means for communication with evaporative emission space of said evaporative emission control system, a movable wall that separates an air pumping chamber space of said housing from a vacuum chamber space of said housing, said inlet means including a one-way valve communicating an inlet of said air pumping chamber space to atmosphere such that air can enter, but not exit, said air pumping chamber space via said inlet means, outlet means including a second one-way valve communicating an outlet of said air pumping chamber space to such evaporative emission space such that air can exit, but not enter, said air pumping chamber space via said outlet means, said pump further comprising a mechanical spring that acts on said movable wall in a sense urging said movable wall to compress air in said air pumping chamber space, and means for alternately communicating said vacuum chamber space to engine intake manifold vacuum and to atmosphere such that when said vacuum chamber space is communicated to intake manifold vacuum, said movable wall executes an intake stroke against force exerted thereon by said mechanical spring to draw air from atmosphere into said air pumping chamber space through said inlet means, and when said vacuum chamber space is communicated to atmosphere, said mechanical spring forces said movable wall to execute a compression stroke to force some of the air from said air pumping chamber space through said outlet means into said evaporative emission space, and sensor means disposed to sense when said movable wall is substantially at one limit of its reciprocation.

26. A pump as set forth in claim 25 characterized further in that said sensor means comprises a switch that senses when said movable wall is completing a compression stroke.

27. A pump as set forth in claim 26 characterized further in that said switch is disposed on said housing such that said vacuum chamber space is between said air pumping chamber space and said switch.

28. An automotive vehicle comprising an internal combustion engine and a fuel system for said engine which comprises a fuel tank for storing volatile liquid fuel for the engine and an evaporative emission control system which comprises a collection canister that in cooperative combination with head space of said tank cooperatively defines an evaporative emission space wherein fuel vapors generated from the volatilization of fuel in said tank are temporarily confined and collected until periodically purged by means of a canister purge valve to an intake manifold of the engine for entrainment with induction flow of combustible mixture into combustion chamber space of the engine and ensuing combustion in said combustion chamber space, valve means via which said evaporative emission space is selectively communicated to atmosphere, said vehicle further comprising means, including pump means, for distinguishing between integrity and non-integrity of said evaporative emission control system, under conditions conducive to obtaining a reliable distinction between such integrity and non-integrity, against leakage of volatile fuel vapor from that portion thereof which includes said tank, said canister, said valve means, and said canister purge valve, characterized in that said pump means comprises a reciprocating pump having a mechanism that, while said valve means is closed to prevent communication of said evaporative emission space to atmosphere and while said canister purge valve is closed to prevent communication of said evaporative emission space to said intake manifold, executes reciprocating motion to create pressure in said evaporative emission space that, in the absence of a gross leak, is substantially different from ambient atmospheric pressure, and sensor means associated with said mechanism to provide both a signal that is used both in controlling the reciprocation of said mechanism and for distinguishing between integrity and non-integrity of said evaporative emission control system.

29. A method for distinguishing between integrity and non-integrity of an evaporative emission control system of an internal combustion engine powered automotive vehicle having a fuel tank for storing volatile liquid fuel for the engine, said evaporative emission control system comprising a collection canister that in cooperative combination with headspace of said tank cooperatively defines an evaporative emission space wherein fuel vapors generated from the volatilization of fuel in said tank are temporarily confined and collected until periodically purged to the engine through a canister purge valve, and valve means via which said evaporative emission space is selectively communicated to atmosphere, said method characterized by closing both said valve means and said canister purge valve, and while they are closed, creating in said evaporative emission space pressure that is significantly different from atmospheric pressure under conditions conducive to obtaining a reliable distinction between such integrity and non-integrity, wherein the step of creating pressure in said evaporative emission space that is significantly different from atmospheric pressure comprises operating a pump that comprises a mechanical spring means and a movable wall that is operable to expand and contract the volume of an air pumping chamber space, said operating step comprising causing said movable wall to execute an intake stroke that expands said air pumping chamber space and causes a measured charge of atmospheric air to be drawn in said air pumping chamber space and energy to be stored in said mechanical spring means, and after the intake stroke, allowing said mechanical spring means to contract said air pumping chamber space by releasing energy stored in said mechanical spring means to move said movable wall along a compression stroke that compresses said measured charge volume of air to pressure greater than atmospheric pressure and forces a portion thereof into said evaporative emission space.

30. A method as set forth in claim 29 characterized further in that said movable wall is caused to execute an intake stroke by communicating engine vacuum to a vacuum chamber space of said pump that is on the opposite side of said movable wall from said air pumping chamber space, and in that a compression stroke is initiated by venting said vacuum chamber space after an intake stroke.

31. For use in an automotive vehicle comprising an internal combustion engine and a fuel system for said engine which comprises a fuel tank for storing volatile liquid fuel for the engine and an evaporative emission control system which comprises a canister purge valve, a collection canister that in cooperative combination with head space of said tank cooperatively defines an evaporative emission space wherein fuel vapors generated from the volatilization of fuel in said tank are temporarily confined and collected until periodically purged to said engine by said canister purge valve, and vent valve means via which said evaporative emission space is selectively communicated to atmosphere;

a pump for distinguishing between integrity and non-integrity of said evaporative emission control system, under conditions conducive to obtaining a reliable distinction between such integrity and non-integrity, against leakage of volatile fuel vapor from that portion thereof which includes said tank, said canister, said vent valve means, and said canister purge valve, said pump being a positive displacement reciprocating pump comprising:

a mechanism that, while said vent valve means is closed to prevent communication of said evaporative emission space to atmosphere and while said canister purge valve is closed to prevent communication of said evaporative emission space to said engine, executes reciprocating motion comprising an intake stroke and a compression stroke and that comprises means to intake air during an intake stroke for creating a measured charge volume of air at given pressure and means to compress said measured charge volume of air to pressure greater than such given pressure and force a portion thereof into said evaporative emission space on a compression stroke, wherein said means to compress said measured charge volume of air to pressure greater than such given pressure and force a portion thereof into said evaporative emission space on a compression stroke comprises mechanical spring means to which energy is imparted during an intake stroke and which releases energy during a compression stroke.

32. A pump as set forth in claim 31 in which said mechanical spring means comprises a helical coiled spring.

33. A method as set forth in claim 29 wherein said pump is reciprocated to build the pressure in said evaporative emission space to a predetermined target pressure, and thereafter is operated to maintain said target pressure by replenishing any losses due to leakage in said evaporative emission space, and such leakage is measured by measuring the rate at which said pump reciprocates.

* * * * *